US007937863B2

(12) United States Patent
Norwood

(10) Patent No.: US 7,937,863 B2
(45) Date of Patent: May 10, 2011

(54) AIR FRESHNER DEVICE

(76) Inventor: Joseph Clinton Norwood, Livermore, CA (US)

( * ) Notice: Subject to any disclaimer, the term of this patent is extended or adjusted under 35 U.S.C. 154(b) by 1275 days.

(21) Appl. No.: 11/273,076

(22) Filed: Nov. 12, 2005

(65) Prior Publication Data

US 2007/0107278 A1 May 17, 2007

(51) Int. Cl.
*G09F 19/08* (2006.01)

(52) U.S. Cl. ..... 40/425; 40/421

(58) Field of Classification Search ..... 40/424, 40/425; 239/60

See application file for complete search history.

(56) References Cited

U.S. PATENT DOCUMENTS

| | | | | | |
|---|---|---|---|---|---|
| 2,120,204 | A | * | 6/1938 | Langhorst | 239/54 |
| D138,777 | S | * | 9/1944 | Lewis | D21/594 |
| 2,760,303 | A | * | 8/1956 | Del Mas | 446/97 |
| 2,976,000 | A | * | 3/1961 | Gunderson | 248/156 |
| 3,417,496 | A | * | 12/1968 | Von Meyer | 40/638 |
| 4,352,461 | A | | 10/1982 | Orta et al. | 239/211 |
| D294,843 | S | * | 3/1988 | Lund | D21/594 |
| 4,814,212 | A | * | 3/1989 | Spector | 428/14 |
| 4,872,278 | A | * | 10/1989 | Ross et al. | 40/424 |
| D354,038 | S | * | 1/1995 | Redhawk | D12/191 |
| D429,325 | S | * | 8/2000 | Macaree | D23/367 |
| 6,764,656 | B1 | * | 7/2004 | Matulevich | 422/124 |
| 6,843,965 | B2 | * | 1/2005 | Matulevich | 422/124 |
| D506,226 | S | * | 6/2005 | Koval et al. | D20/33 |
| 2004/0093781 | A1 | * | 5/2004 | Sievers | 40/745 |

FOREIGN PATENT DOCUMENTS

| | | | | |
|---|---|---|---|---|
| GB | 2332475 | A | * | 6/1999 |
| JP | 09237049 | A | * | 9/1997 |
| WO | WO 2007132036 | A1 | * | 11/2007 |

OTHER PUBLICATIONS

Internet pages of Car-Freshner Corporation entitled "What's New", 6 pages, printed Oct. 6, 2005.

* cited by examiner

*Primary Examiner* — Cassandra Davis
(74) *Attorney, Agent, or Firm* — Imperium Patent Works LLP; T. Lester Wallace; Amir V. Adibi

(57) ABSTRACT

An air freshener device comprises one or more planar elements that can move relative to a base, where each planar element is connected to the base by a flexible connector, and where each planar element releases a fragrance. The planar elements and the flexible connectors are disposed in a plane. The planar elements may be made of an inexpensive paper material and may bear images or text. The air freshener device imparts fragrance to an area and has moving parts that entertain viewers and also attract the attention of viewers. When mounted in an automobile, for example, the device can entertain child or adult passengers. The device can also convey a statement, using images or text, to drivers of nearby automobiles, who will notice the device because of its motion.

18 Claims, 3 Drawing Sheets

AIR FRESHNER DEVICE

TECHNICAL FIELD

The present invention relates to the field of devices to disperse fragrance within an area such as the interior of a home or an automobile.

BACKGROUND

Air fresheners are commonly used to impart a pleasant fragrance within an area such as the interior of a home or an automobile. Air fresheners disperse volatile compounds that the human olfactory system perceives as fragrances. Mechanisms for dispersing the fragrant compounds include passive evaporation or diffusion from a substrate impregnated with the fragrant compound and active evaporation or diffusion induced by heat or by a stream of flowing air.

One air freshener device made of a thick paper-like material impregnated with a fragrant compound and shaped like the silhouette of a coniferous tree has been sold for many years by CAR-FRESHNER Corporation as an air freshener for automobiles. This air freshener device hangs from an interior part of the automobile but is relatively static.

Motion of part or all of an air freshener device can assist the dispersal of fragrance. U.S. Pat. No. 4,352,461 discloses an air freshener device comprising a container of liquid fragrance oscillated on a flexible rod attached to a suction cup mountable on the dashboard of an automobile.

Some air freshener devices convey an impression of action or motion through, for example, parts that move relative to one another. U.S. Pat. No. 6,764,656 discloses a sports figure shaped fan, containing a scent reservoir, that attaches to an automobile ventilation grill. Air flow from the ventilation grill disperses scent and causes the figure's arms to extend and rotate as if throwing a ball. One disadvantage of the U.S. Pat. No. 6,764,656 device is the necessity to attach the device to a ventilation grill rather than to some other part of an automobile such as the rear window, where the moving device might be more visible.

The GAME PLAY air freshener device sold by CAR-FRESHNER Corporation comprises two sports-related items, such as a baseball and a baseball mitt, that are connected so that the parts move somewhat relative to one another.

SUMMARY

An air freshener device in accordance with one novel aspect comprises one or more substantially planar elements that can move relative to a base, each substantially planar element being connected to the base by a flexible connector. The substantially planar elements and the flexible connectors are disposed in a plane. The substantially planar elements may bear images or text. The air freshener device imparts fragrance to an area and has moving parts that entertain viewers and also attract the attention of viewers. When mounted in an automobile, for example, the air freshener device can entertain child or adult passengers. The substantially planar elements are made to move with respect to one another and the base by movement of the vehicle to which the base is attached. The substantially planar elements may also be made to move to some extent by air currents in the vehicle.

In some embodiments, the air freshener device conveys a statement, using images or text, to drivers of nearby automobiles, whose attention may be drawn to the air freshener device due to its motion. The images and/or text on the air freshener device may, for example, relate both to a scene depicted on the first and second planar elements of the air freshener device, as well as to the driving of a vehicle.

Other embodiments and advantages are described in the detailed description below. This summary does not purport to define the invention. The invention is defined by the claims.

DETAILED DESCRIPTION

Reference is now made in detail to some embodiments of the invention, examples of which are illustrated in the accompanying drawings.

Figure 1:
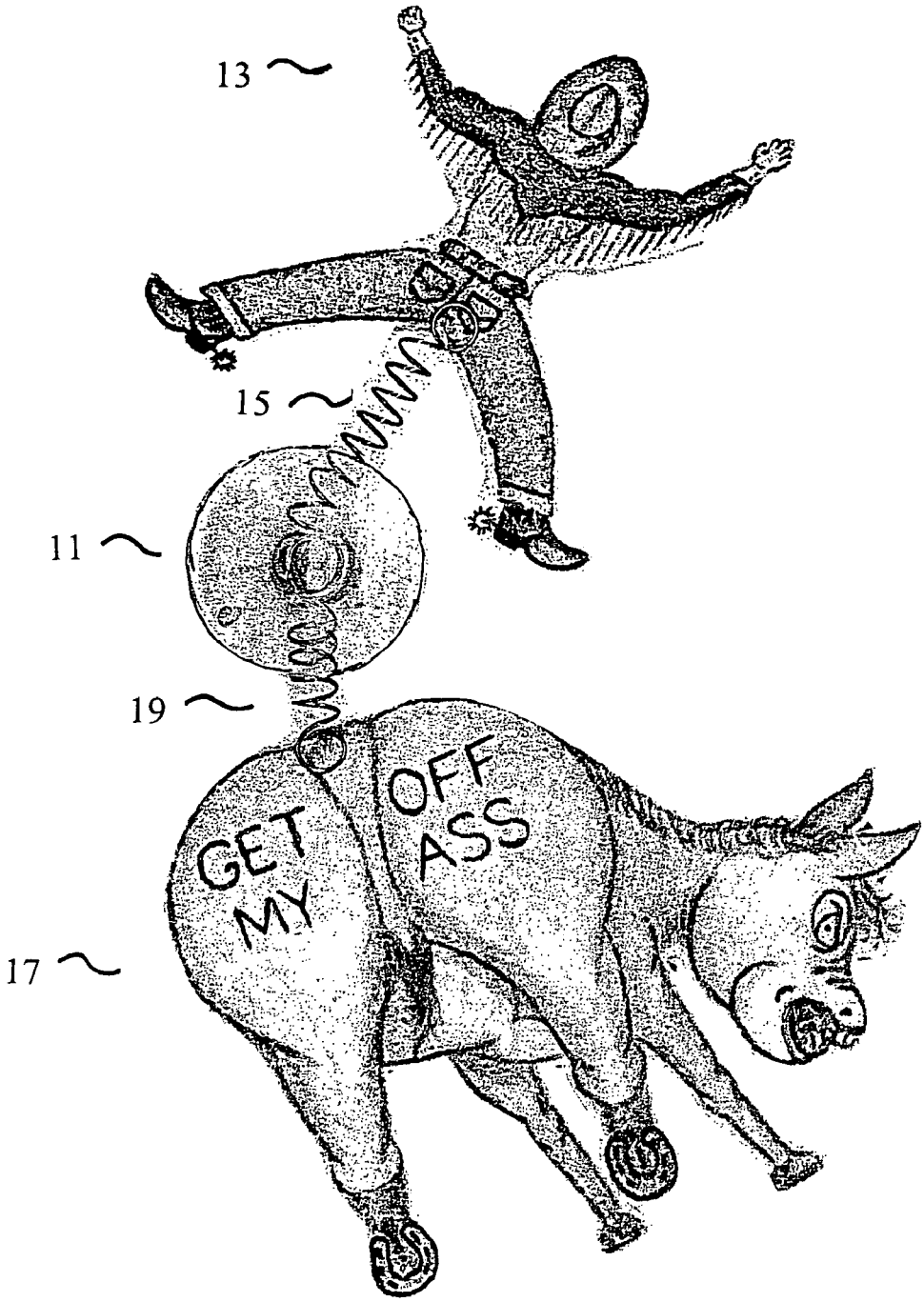
FIG. 1 illustrates a frontal view of an air freshener device in accordance with an embodiment of the present invention.

FIG. 1 illustrates a frontal view of an air freshener device in accordance with an embodiment of the present invention. The device comprises two substantially planar elements 13 and 17 that can move relative to a base member 11. The substantially planar elements 13 and 17 are connected to the base member 11 by flexible connectors 15 and 19 which can be, for example, springs or flexible rods or flexible strips.

The air freshener device comprises a base member 11 for attachment to a vehicle, a first substantially planar element 13 that disperses a fragrance, a first flexible connector 15 that connects the first substantially planar element to the base member 11, a second substantially planar element 17 that disperses a fragrance, and a second flexible connector 19 that connects the second substantially planar element to the base member 11. The first and second substantially planar elements are disposed substantially in the same plane. The first and second flexible connectors allow the first and second substantially planar elements to jiggle and move with respect to one another. The first substantially planar element 11 bears an image of a first object, the second substantially planar element 17 bears an image of a second object, the first and second objects are two objects in the same scene, and the first and second objects physically interact with one another in the scene. The second substantially planar element 17 includes text whose characters are at least one quarter inch tall. The text communicates a humorous play on words that relates both to driving of a vehicle as well as to the scene depicted by the images. Here the scene is of a cowboy being kicked off the hindquarters of an ass, where the first object depicted on first substantially planar element 13 is the cowboy, where the second object depicted on second substantially planar element 17 is the ass, and where the air freshener device is attached to an inside surface of a rear window of a vehicle, the text reads "GET OFF MY ASS". Where as here the air freshener device is adapted to be attached to an inside surface of a rear window of a vehicle such that the text can be read through the window from outside the vehicle, the text and images are disposed on the planar sides of the first and second substantially planar elements that face the window. The images can also be replicated on the other planar sides of the first and second substantially planar elements so that the scene can also be viewed from inside the vehicle. The top-down contour shapes of the first and second substantially planar elements 13 and 17 are not regular shapes, but rather are irregular shapes that define the contours of the objects depicted.

The air freshener device of FIG. 1 is inexpensive and easy to manufacture because it involves two pieces of impregnated paper, two springs, and a suction cup. The various parts can be assembled by hand. The images can be printed onto paper, and the printed paper can be laminated onto the impregnated paper prior to the first and second substantially planar elements being cut or stamped into their final shapes. Even if the paper upon which the images were printed does not allow the fragrance to pass through it, the fragrance can nonetheless escape through the other side of the substantially planar elements. Alternatively, the images can be printed or sprayed or otherwise applied directly to the impregnated paper of the first and second substantially planar element themselves.

Figure 2:
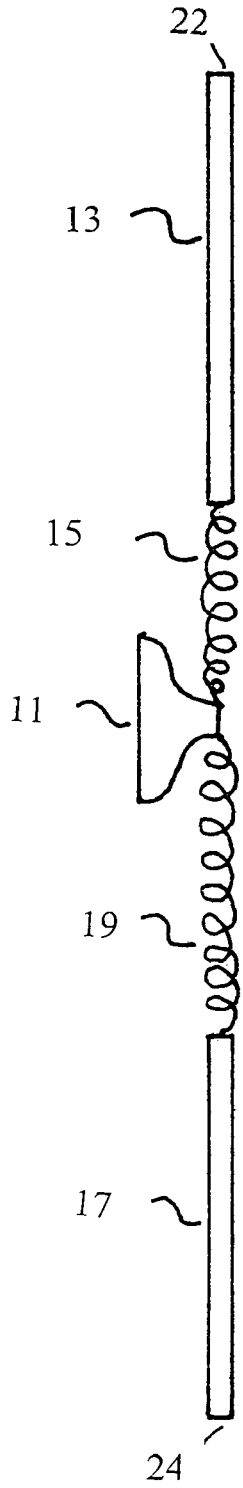
FIG. 2 illustrates a side view of the air freshener device of FIG. 1.

FIG. 2 illustrates a side view of the air freshener device of FIG. 1. As seen in FIG. 2, the substantially planar elements 13 and 17 and the flexible connectors 15 and 19 are disposed within a plane. The plane may be envisioned as extending vertically and bisecting the substantially planar elements 13 and 17 and the flexible connectors 15 and 19 along a line that passes through the tips 22 and 24 of the substantially planar elements 13 and 17. While the substantially planar elements 13 and 17 may shift slightly out of the plane due to flexing and movement of the flexible connectors 15 and 19, the substantially planar elements 13 and 17 are disposed primarily within the plane.

The air freshener device may be attached to a support. The support may be, for example, the door of a kitchen cupboard in a home, or an interior element of an automobile such as the interior surface of an automobile window. The base member 11 may include, for example, a suction cup or a clip or a surface coated with a removable adhesive, any of which can serve to attach the air freshener device to a support while allowing easy removal of the device from the support. Easy removal of the device from the support is desirable because air freshener devices are replaced periodically when the fragrance within a device is exhausted. Where the base member is a clip or clamp, the air freshener device is attachable to the rear view mirror inside a vehicle or to a visor inside a vehicle.

Removable adhesives are commonly used to secure objects to one another yet enable easy separation of the objects. The preparation and use of products containing removable adhesives are well known to those skilled in the art. Products employing removable adhesives include, for example, repositionable products available under the trade designation "Post-it" from Minnesota Mining and Manufacturing Company ("3M") of St. Paul, Minn. U.S. Pat. No. 6,692,807, which is incorporated by reference herein, describes materials and structures that use removable adhesives to effect separable connections.

Figure 3:
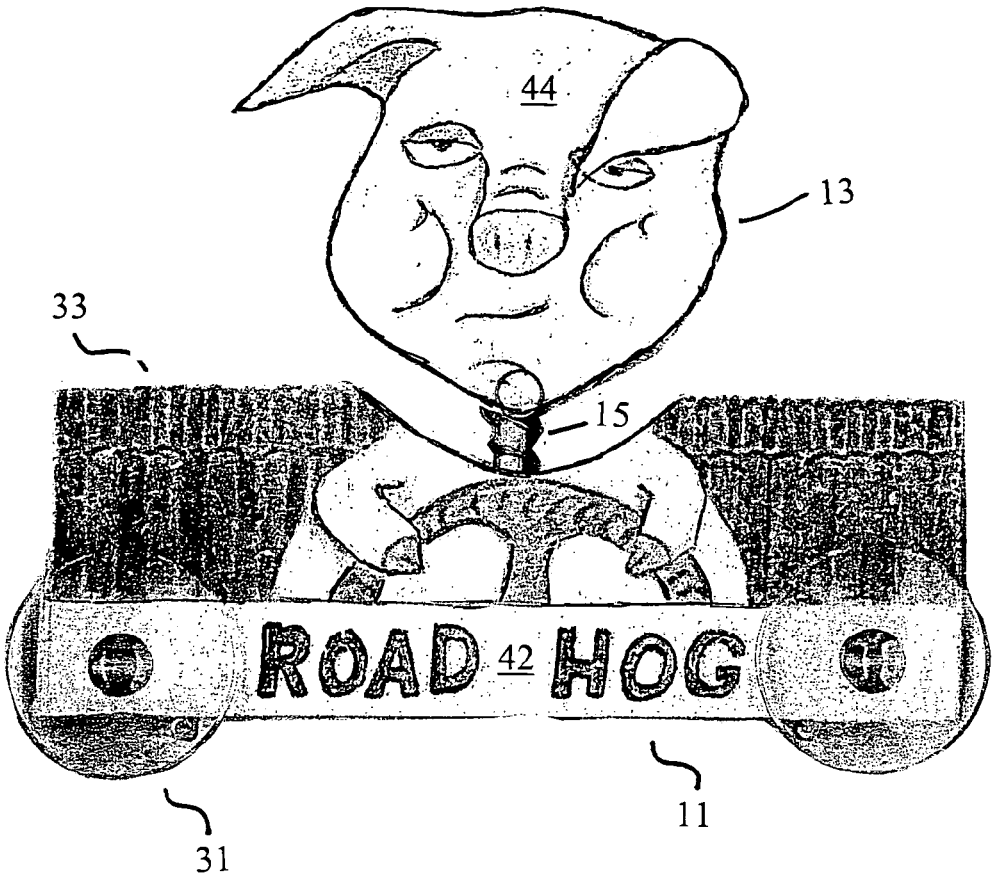
FIG. 3 illustrates a frontal view of an air freshener device in accordance with an embodiment of the present invention.

FIG. 3 illustrates a frontal view of another embodiment of an air freshener device. In this embodiment, the base member 11 comprises a substantially planar element 33 and two suction cups. Suction cup 31 is one of these cups. This device includes a second substantially planar element 13 that can move relative to the base member 11. The second substantially planar element 13 is connected to the base member 11 by a flexible connector 15 which can be, for example, a spring or a flexible rod or a flexible strip. In this case, a piece of wooden dowel is disposed within the axial volume of the spring in order to change the type of relative motion between base member 11 and second substantially planar element 13. Second substantially planar element 13 bends about a pivot point where it is anchored to the base member 11. Second substantially planar element 13 tends not to bob up and down. The second substantially planar element 13 is therefore seen to wave from side to side like a windshield wiper.

Figure 4:
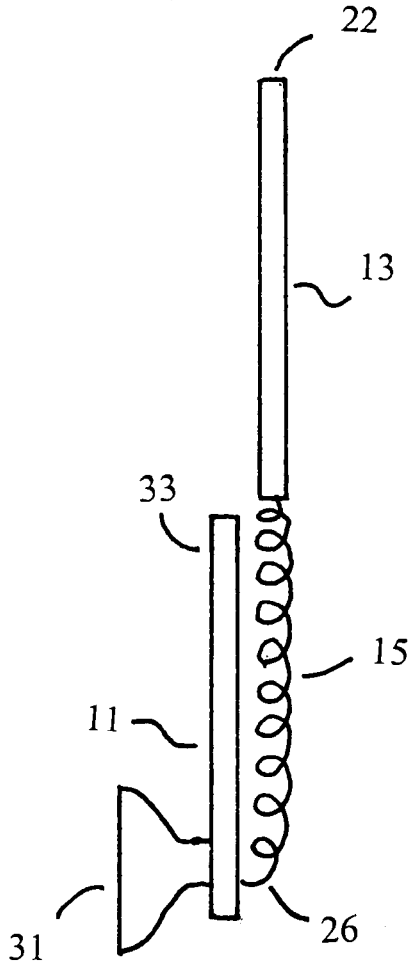
FIG. 4 illustrates a side view of the air freshener device of FIG. 3.

FIG. 4 illustrates a side view of the air freshener device of FIG. 3 (dowel is not shown). As seen in FIG. 4, the second substantially planar element 13 and the flexible connector 15 are disposed within a plane. The plane may be envisioned as extending vertically and bisecting the second substantially planar element 13 and the flexible connector 15 along a line that passes through the tip 22 of the substantially planar element 13 and the end 26 of the flexible connector 15. While the second substantially planar element 13 may shift slightly out of the plane due to flexing of the flexible connector 15, the second substantially planar element 13 is disposed primarily within the plane.

The substantially planar elements 13 and 17 and 33 may, for example, be made of a thick paper or other absorbent sheet material impregnated with any of various volatile compounds that human beings perceive as fragrances. The preparation and use of such fragrance-impregnated paper is well known to those skilled in the art. The substantially planar elements may be cut out of or stamped but of a larger sheet or larger sheets of the sheet material.

The substantially planar elements 13, 17 and 33 may include images having, for example, lines, multiple colors and/or shapes; an image may also be a silhouette. In FIG. 3, image 44 depicts a stylized grinning face of an animal (in this case, a pig or "hog"). The substantially planar elements 13, 17 and 33 may include text such as words, slogans, or messages. In FIG. 3, text 42 displays the words "ROAD HOG". The text communicates a humorous play on words that relates both to the scene depicted, as well as to the driving of a vehicle. The term "hog" refers both to the animal, as well as to a selfish driving habit. The scene involves a hog in that the image on substantially planar element 13 is an image of the face of a hog. The image on substantially planar element 33 is an image involving a steering wheel of a vehicle. The chest of the hog as well as two of the hog's feet are illustrated as if the hog were sitting on seat behind the steering wheel and as if the hog were steering the steering wheel. The scene is therefore of a pig or "hog" driving a vehicle. The object depicted on substantially planar element 13 (the head of the hog) physically interacts with the object depicted on substantially planar element 33 (the chest of the hog's body, the hog's feet, the steering wheel, and the vehicle seat) in the scene.

Although the present invention has been described in connection with certain specific embodiments for instructional purposes, the present invention is not limited thereto. The scene depicted and the text borne by the air freshener device need not relate to driving a vehicle. For example, a substantially planar element may point to an occupant of a vehicle, and the text borne by the air freshener device may communicate a statement about the occupant. The text may, for example, laud or disparage the driving skills of the driver, or comment on the aptitudes of a backseat driver. A substantially planar element of an air freshener device may be a caricature of a famous individual, and the text borne by the air freshener device may communicate a statement that relates to the famous individual. The statement may, for example, be a political statement or slogan. The scene illustrated on the air freshener as well as the text may relate to a sport, hobby, or other vocation or activity. The air freshener device need not be used in a vehicle, but rather can be used in the home, or office. The air freshener device may, for example, be fixed to a baby carriage more for novelty sake than for its ability to dispense fragrance. The air freshener device may include circuitry for generating sound such as the circuitry typically incorporated into talking greeting cards. Accordingly, various modifications, adaptations, and combinations of various features of the described embodiments can be practiced without departing from the scope of the invention as set forth in the claims.

What is claimed is:

1. A device comprising:

a base member;

a first substantially planar element that disperses a fragrance and that moves relative to the base member, wherein the first substantially planar element is disposed substantially in a plane;

a flexible connector that is disposed substantially in the plane and that holds the first substantially planar element to the base member;

a second substantially planar element that disperses a fragrance and that moves relative to the base member, wherein the second substantially planar element is disposed substantially in the plane; and a second flexible connector that is disposed substantially in the plane and that holds the second substantially planar element to the base member.

2. The device of claim 1, wherein the flexible connector is a spring, wherein the second flexible connector is a second spring, and wherein the base member is a suction cup.

3. The device of claim 1, wherein the base member includes a surface bearing an adhesive.

4. The device of claim 1, wherein the base member includes a clip.

5. The device of claim 1, wherein the first substantially planar element bears an image, and wherein the second substantially planar element bears an image.

6. The device of claim 5, wherein the first substantially planar element also bears text.

7. A device comprising:

a base member, wherein the base member includes means for attachment to a support, wherein the base member also includes a first substantially planar element that disperses a fragrance;

a second substantially planar element that disperses a fragrance and that moves relative to the base member, wherein the second substantially planar element is disposed substantially in a plane; and a flexible connector that is disposed substantially in the plane and that holds the second substantially planar element to the base member.

8. A device, comprising:

a substantially rigid base member that secures the device to a vehicle;

a first substantially planar element that disperses a fragrance and that moves relative to the base member, wherein the first substantially planar element is oriented substantially in a plane, wherein the first substantially planar element bears a first image of a first object;

a second substantially planar element that disperses a fragrance and that moves relative to the base member, wherein the second substantially planar element is oriented substantially in the plane, wherein the second substantially planar element bears a second image of a second object, wherein the first object and the second object are two objects in a scene, and wherein the first object and the second object physically interact with one another in the scene;

a first flexible connector that is oriented substantially in the plane and that holds the second substantially planar element to the base member; and a second flexible connector that is oriented substantially in the plane and that holds the second substantially planar element to the base member.

9. The device of claim 8, wherein the first substantially planar element is a first piece of a paper material that is cut from a larger sheet of the paper material.

10. The device of claim 8, wherein the first image includes an image of a first part of a non-plant living body, and wherein the second image includes an image of a second part of the non-plant living body, the non-plant living body being taken from the group consisting of: an animal and a human being.

11. The device of claim 8, wherein the first image includes an image of at least part of a non-plant living body, the non-plant living body being taken from the group consisting of: an animal and a human being.

12. The device of claim 8, wherein the first object also bears text, the text having multiple characters, each character being at least one quarter inch tall.

13. A device, comprising:

a base member that is substantially rigidly secured to a vehicle;

a first substantially planar element that disperses a fragrance, wherein the first substantially planar element bears a first image of a first object;

a second substantially planar element that disperses a fragrance, wherein the first substantially planar element and the second substantially planar element are disposed substantially in a single plane, wherein the second substantially planar element bears a second image of a second object, wherein the first object and the second object are two objects of a scene, and wherein the first object and the second object physically interact with one another in the scene; and a flexible connector coupled to the first substantially planar element such that the first substantially planar element moves with respect to the second substantially planar element.

14. The device of claim 13, wherein one of the first substantially planar element and the second substantially planar element includes text, the text having multiple characters, each character being at least one quarter inch tall.

15. The device of claim 14, wherein the first substantially planar element is disposed substantially in a first plane, and wherein the second substantially planar element is disposed substantially in a second plane.

16. The device of claim 14, wherein the text relates both to driving of a vehicle as well as to the scene.

17. The device of claim 14, wherein the text is a political statement.

18. The device of claim 7, wherein the flexible connector comprises a spring, wherein the base member is substantially rigidly attached to a vehicle, wherein the second substantially planar element comprises a piece of sheet material cut from a larger piece of the sheet material, and wherein the first substantially planar element bears text, the text including characters, each character being at least one quarter inch tall.

* * * * *